US005276946A

United States Patent [19]

Pinto et al.

[11] Patent Number: 5,276,946

[45] Date of Patent: Jan. 11, 1994

[54] MULTIPLE BALE OPENER

[75] Inventors: Akiva Pinto, Duesseldorf-Wittlaer; Guenter Lucassen, Haltern, both of Fed. Rep. of Germany

[73] Assignee: Hergeth Hollingsworth GmbH, Duelman, Fed. Rep. of Germany

[21] Appl. No.: 852,161

[22] PCT Filed: Oct. 3, 1990

[86] PCT No.: PCT/EP90/01657

§ 371 Date: Apr. 3, 1992

§ 102(e) Date: Apr. 3, 1992

[87] PCT Pub. No.: WO91/05093

PCT Pub. Date: Apr. 18, 1991

[30] Foreign Application Priority Data

Oct. 5, 1989 [DE] Fed. Rep. of Germany ..... 3933274

[51] Int. Cl.[5] ..... D01G 7/08

[52] U.S. Cl. ..... 19/97.5

[58] Field of Search ..... 19/80R, 80A, 97.5, 145.5

[56] References Cited

U.S. PATENT DOCUMENTS

| | | | |
|---|---|---|---|
| 2,938,239 | 5/1960 | Leineweber, Jr. | 19/80 R |
| 3,381,341 | 5/1968 | Platt et al. | 19/80 R |
| 3,576,284 | 4/1991 | Fellous et al. | 226/97 |
| 3,736,624 | 6/1973 | Alt et al. | 19/80 R |
| 4,100,651 | 7/1978 | Wornall et al. | 19/145.5 |
| 4,377,021 | 3/1983 | Peters | 19/80 R |
| 4,888,857 | 12/1989 | Pinto et al. | 19/80 R |
| 4,920,613 | 5/1990 | Binder et al. | 19/80 R |
| 4,951,358 | 8/1990 | Binder et al. | 19/80 R |
| 5,025,533 | 6/1991 | Faas et al. | 19/80 R |

FOREIGN PATENT DOCUMENTS

| | | | |
|---|---|---|---|
| 2416944 | 9/1975 | Fed. Rep. of Germany . | |
| 9105092 | 4/1991 | PCT Int'l Appl. | 19/80 R |

*Primary Examiner*—Clifford D. Crowder
*Assistant Examiner*—Michael A. Neas
*Attorney, Agent, or Firm*—Leatherwood Walker Todd & Mann

[57] ABSTRACT

In a multiple bale opener (1) comprising a transport device leading pressed fiber bales (14,16) to a horizontal reduction area (3), the transport device having a section (20) rising towards the reduction area, and a reduction device (5) moved back and forth in the reduction area, it is provided. The transport device has a plurality of adjacent independent transport tracks (2,4,6,8), and the transport tracks (2,4,6,8) are pivotably supported at the rear end of the reduction area (3), seen in the direction of transport. The distance of each of the transport tracks (2,4, 6,8) to the plane of reduction can be adjusted separately at the front end of the reduction area (3), seen in the direction of transport, and the transport velocity of each of the transport tracks (2,4,6,8) can be adjusted separately.

4 Claims, 2 Drawing Sheets

MULTIPLE BALE OPENER

BACKGROUND OF THE INVENTION

The invention relates to a multipe bale opener with a transport device being inclined with respect to the plane of reduction and guiding pressed fiber bales to a horizontal plane of reduction, and with a reduction device shuttling in the plane of reduction, as well as to a method of opening and mixing different pressed fiber bales.

Such a bale opening device is known from DE-OS 20 61 044, according to which the pressed fiber bales set up in rows may be continuously fed longitudinally thereto, while the reduction is performed. In this case, the opening device may be displaced to and fro along a straight guide relative to the rows of bales, while the fiber material is fed along a rising ramp.

Such a multiple bale opener has the drawback that, substantially, it can only process batches of raw material that are uniform in height. Cotton mixtures of different origin indeed have bale dimensions varying considerably so that a manual levelling of the height has to be performed before the desired cotton mixture can be reduced by the known multiple bale opening device. In practice, the height differences are levelled by severing an upper portion from higher bales and putting these portions on the lower bales. This, however, entails a considerable variation in the mixture ratio of the batch.

It is a further drawback that mixture ratios can only be set as integral bale number ratios, namely ratios lying within the scope of the number of bales that are simutaneously reduced on the ramp.

It is an object of the invention to improve a multiple bale opener and a method for opening and mixing different pressed fiber bales such that an optional selectable and readily changeable mixture ratio can be set.

The object is soved with the features of the claims.

SUMMARY OF THE INVENTION

The transport device of the present invention, having a plurality of adjacent and independent, transport tracks, for instance allows the transport of cotton of different origin and different bale dimensions on each track. A desired optional mixture ratio can be adjusted with high accuracy by regulating the transport velocity. It is essential that this mixture ratio can be adjusted smoothy and may be changed at any time. Thus, it is possible, for instance, to compose different batches from one supply of bales without interrupting the reduction process. It is not necessary to change the arrangement of bales in order to change the mixture ratio.

Besides the exactness of the adjustment of the mixture ratio, it is a further advantage that any mixture ratio of the four bale rows can be selected, e.g. 2.5% of the first row of bales, 45% of the second row, 21% of the third row and 2.5% of the fourth row. Previously, such mixture ratios could not be set, since the composition of the mixture had to rely on the quantitive relation between simultaneously reduced whole bales.

Each transport track may be lifted such that the upper edge of every pressed fiber bale at the beginning of a surface to be reduced has the same height as the adjacent rows of bales. Due to the different angular positions of the individual transport tracks relative to the reduction plane, there will occur different lifts for levelled bale supply, provided that the transport velocities are the same, which, however, can be compensated by setting corresponding transport velocities.

Preferably, the reduction device is provided so as to be shuttled parallel to the direction of transport in the region of the reduction area, the length of the reduction device corresponding to the width of all transport tracks transversal to the direction of transport. In this preferred embodiment, the reduction device, e.g. a milling device, is guided parallel to the transport device.

According to the present invention, the method of opening and mixing different pressed fiber bales is characterized in that a plurality of pressed fiber bales arranged side by side are supplied on separate transport tracks, pressed fiber bales or a mixture of pressed fiber bales of a uniform bale height being supplied on each transport track, and in that a certain mixture ratio of the pressed fiber bales or the mixture of pressed fiber bales suppied on the individual transport tracks is adjusted via the transport velocity of the individual transport tracks.

In the present method, it is advantageously provided that the individual rows of pressed fiber bales are supplied at different speeds, whereby the mixture ratio between the individual rows of pressed fiber bales can be set exactly. Here, a uniform ramp angle is provided for the individual transport tracks. In this way, bales of lower height will enter the reduction area later than higher bales, which, however, may be compensated by a higher transport velocity.

However, the rows of pressed fiber bales arranged side by side and having different heights are preferably supplied by varying the angle of the ramp of each transport track. In this way, it is ensured that all four rows of pressed fiber bales can be worked on over the entire reduction area.

The individual rows of pressed fiber bales themselves may contain a bale mixture of fiber bales being of equal height, the number of pressed fiber bales depending on the number of pressed fiber bales that can be simultaneously worked on in the direction of transport in the reduction area.

BRIEF DESCRIPTION OF THE DRAWINGS

The following is a detaied description of an embodiment of the invention with reference to the accompanying drawings.

In the Figures.

Figure 1:
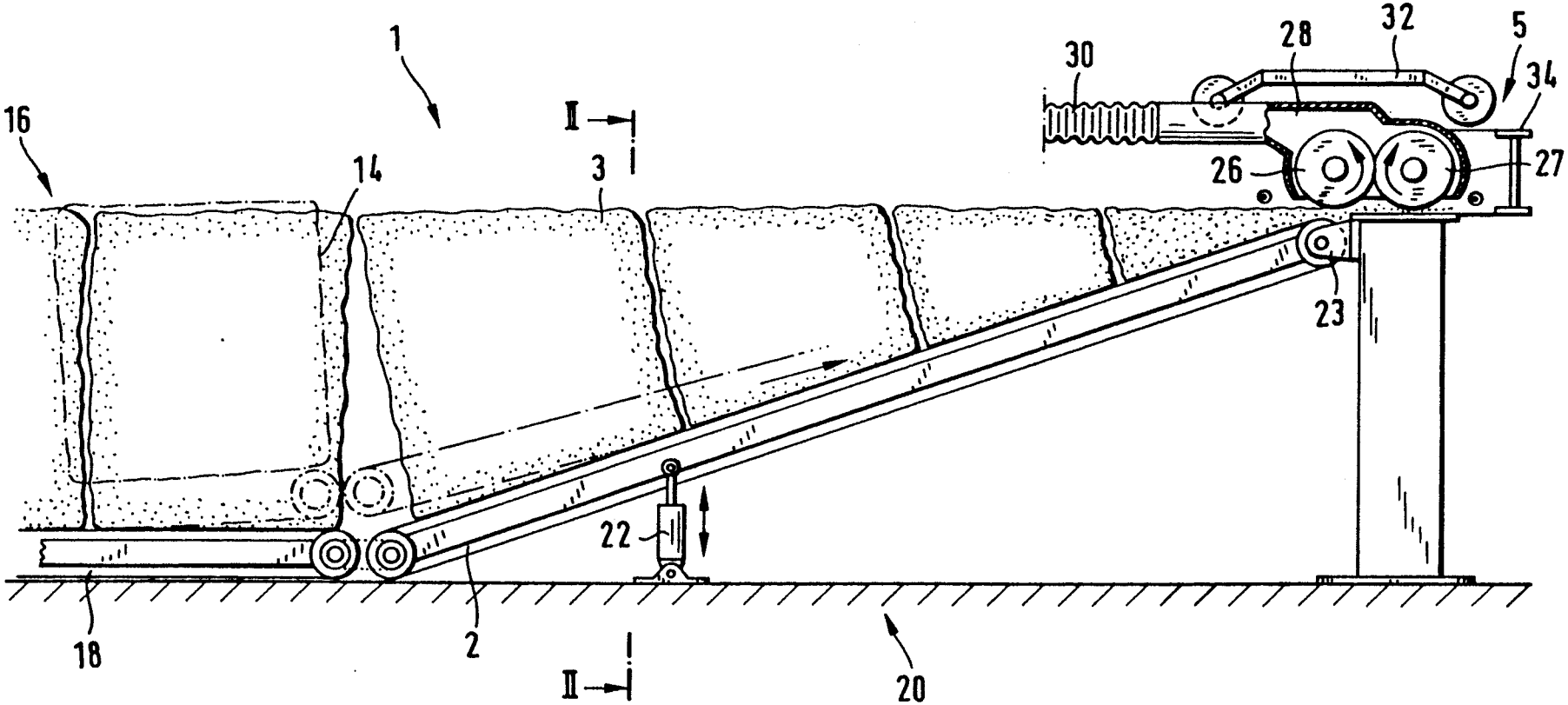
FIG. 1 is a schematical illustration of a multiple bale opener according to the present invention in vertical section.

The multiple bale opener has a transport means consisting of a plurality of adjacenty arranged parallel transport tracks 2,4,6,8 that, in the case of the embodiment shown in the Figures, can accomodate four rows of bales 10, 12, 14, 16 side by side.

The individual transport tracks 2, 4, 6, 8 preferably consist of continuously driven transport belts which extend substantially horizontally in a front section 18—seen in the direction of transport—on which the batch may be supplied, and a rear section 20 of which rises in the manner of a rising ramp in the region of a reduction area worked on by the reduction device 5, the rear section rising such that the end section of the running belt extends up to the plane of reduction of the reduction area 3. At this upper end of the running belt, the transport tracks 2, 4, 6, 8 are held in bearings 23 so as to be pivotable around a common axis of rotation, the lower end of the oblique transport tracks 2,4,6,8 being lifted in dependence on the height of the respective supplied bales such that the upper edges of the respective supplied rows of bales enter the plane of reduction of the reduction area 3 at the same height.

Preferably, the transport tracks 2,4,6,8 are subdivided once or several times, the last subdivision being provided at the beginning of the reduction area 3. As illustrated in FIG. 1, the subdivided transport tracks 2,4,6,8 may be coupled with each other by means of a toothed belt or the like. The front section 18 of the transport track is also supported pivotably in a conventional manner (not shown) at its front end, seen in the direction of transport, in order to allow a variable lifting of the bale rows 10, 12, 14, 16 aready in the first section 18 of the transport track and to allow a quasi smooth transition to the last section of the transport track 20.

Figure 2:
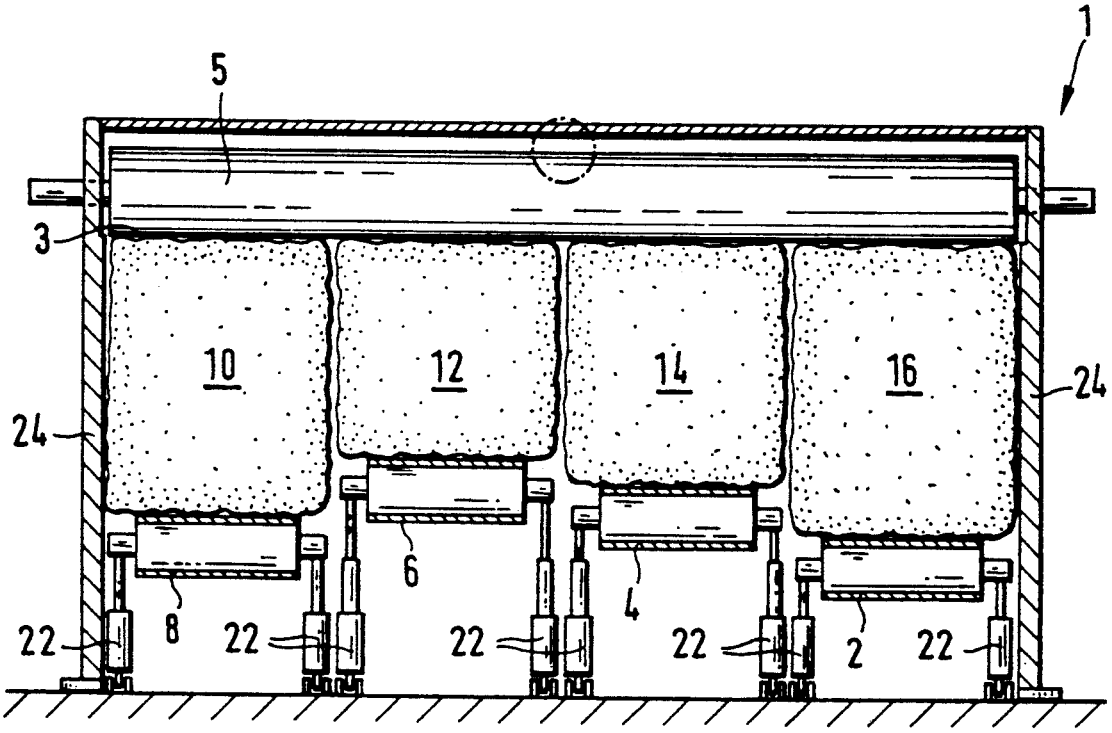
FIG. 2 is a cross sesction of the multiple bale opener along line II'II in FIG. 1.

The lifting of the transport tracks in the region of the reduction area is performed by means of a lifting device 22, e.g. linear motors like hydrauic piston-cyinder units which, as can be seen for example in FIG. 2, may be arranged in pairs at the sides of the transport tracks 2,4,6,8, and which are adjustable to a desired height by means of a suitable control device. Similar lifting devices may also be provided for the front section 18 of the transport track. As illustrated in FIG. 2, the adjacent bale rows 10, 12, 14, 16 are guided up to the end of the ramp formed by the transport tracks 2,4,6,8 by lateral supporting walls 24.

According to the embodiment of FIG. 1, the reduction area 3, seen in the direction of transport, covers approximately the length of four successive bales within each bale row 10, 12, 14, 16.

In FIG. 1, the reduction device 5 is shown in its rear end position with respect to the direction of transport, all 16 bales on the ramp being reduced as supplied upon each shuttling movement of the reduction device 5.

The reduction device 5 substantially consists of two milling rollers 26, 27 rotating in opposite directions which throw the loosened fiber flocks upward between them into a suction chamber 28 from where the flocks are pneumatically transported further via a suction duct 30. The reduction device 5 is lineary guided over the reduction surface 3 by means of an arrangement of rolls and tracks 32, 34.

By adapting the height of the transport tracks 2,4,6,8 to the respective heights of the bales at the beginning of the reduction area 3, bales of different height dimensions can be put onto the individual transport tracks. Thus, it is possible to mix, e.g., cotton bales of different origin in any optional mixture ratio.

The mixture ratio may simply be adjusted by adjusting each the feed velocity of the transport belts separately so that, in the embodiment of FIG. 2, four different qualities can be reduced in an optional mixture and with a constant mixture ratio.

Moreover, it is no problem to change the batch to another mixture without having to replace the bales supplied. For exampel, if the new mixture is to contain only cotton of the bale rows 10, 14 and 16, it is also possible to halt the transport belt of the bale row 12.

Thus, the multiple bale opener 1 allows to compose and process different batches with different mixture ratios from one uniform bale supply.

The features of the present invention disclosed in the above specification, the drawings and the claims, even if described only in connection with a particular embodiment, are essential for the realization of the various embodiments of the invention, both individually and in combination.

We claim:

1. A multiple bale opening device for opening fiber bales, comprising:

transport means for transporting pressed fiber bales;

a horizontal reduction area for receiving fiber bales transported by said transport means, said horizontal reduction area defining a horizontal reduction plane, a first end and a second end opposite said first end;

said transport means including an elevated portion for transporting the fiber bales to said horizontal reduction area;

reduction means associated with said horizontal reduction area for reducing the fiber bales, said reduction means being movable back and forth substantially parallel to said horizontal reduction plane; and said transport means including a plurality of adjacent independent transport tracks for transporting the fiber bales at a transport velocity, said transport tracks being supported adjacent said first end of said reduction area for upward and downward movement, said transport means including lifting means connected to said independent transport tracks for selectively and independently moving each of said independent transport tracks upwardly and downwardly with respect to one another, the distance from each of said independent transport tracks to said horizontal reduction plane being separately adjustable by said lifting means.

2. The multiple bale opener according to claim 1 wherein said reduction means is elongated having a length substantially corresponding to the combined width of said plurality of independent transport tracks.

3. A method of opening and mixing a supply of bales including different pressed fiber bales in a multiple bale opener, comprising:

providing a reduction area for receiving fiber bales;

providing reduction means in said reduction area for milling fiber bales;

providing a plurality of movable independent transport tracks, each having an individually adjustable transport velocity, for transporting the pressed fiber bales up an incline to said reduction area;

arranging a plurality of pressed fiber bales side by side for transport on said independent transport tracks in a predetermined mixture ratio;

transporting a predetermined number of bales in the predetermined mixture ratio on said independent transport tracks up the incline;

milling with said reduction means the fiber bales being continuously transported up the incline;

selectively adjusting the transport velocity of each of said independent transport tracks with respect to one another such that the relative delivery of the fiber bales by said independent transport tracks to said reduction area is varied; and supplying pressed fiber bales of a substantially uniform bale height on each of the transport tracks for maintaining the desired mixture ratio of the pressed fiber bales supplied on the individual transport tracks through said adjustment of the transport velocity of the individual transport tracks with respect to one another.

4. The method according to claim 3 further comprising supplying pressed fiber bales of different height on said independent transport tracks to said reduction area; and selectively varying the angle of each individual independent transport track to selectively adjust the distance between the pressed fiber bales of differ height thereon and the reduction area.

* * * * *